United States Patent [19]

Travillian

[11] Patent Number: 4,768,567

[45] Date of Patent: Sep. 6, 1988

[54] SAND FILL APPARATUS FOR LOST FOAM CASTING

[75] Inventor: Robert M. Travillian, Grosse Pointe Farms, Mich.

[73] Assignee: General Motors Corporation, Detroit, Mich.

[21] Appl. No.: 92,636

[22] Filed: Sep. 3, 1987

[51] Int. Cl.[4] ..... B65B 1/06; B65B 37/02; B22C 9/02; B22C 9/04

[52] U.S. Cl. ..... 141/67; 141/74; 141/249; 164/20; 164/34; 164/349

[58] Field of Search ..... 141/67, 70, 74, 249; 164/34, 19, 20, 349, 192

[56] References Cited

U.S. PATENT DOCUMENTS

| | | | |
|---|---|---|---|
| 3,581,802 | 6/1971 | Krzyzanowski | 164/34 |
| 3,678,989 | 7/1972 | Krzyzanowski | 164/246 |
| 3,861,447 | 1/1975 | Hondo | 164/34 |
| 4,197,899 | 4/1980 | Ernest | 164/34 |
| 4,454,906 | 6/1984 | Musschoot | 164/34 |

*Primary Examiner*—Stuart S. Levy
*Assistant Examiner*—Thomas R. Hannon
*Attorney, Agent, or Firm*—Douglas D. Fekete

[57] ABSTRACT

An apparatus for filling an open-top foundry flask with discrete refractory particles by pluviation to embed an expendable pattern to form a lost foam casting mold comprises conduits for directing pressurized gas toward the prepositioned pattern within the flask to deflect pluviating particles and thereby promote uniform packing of the particles about the pattern. The conduits comprise compressed air conduits vertically insertable into the flask through the open top thereof for disposition about the pattern and having multiple orifices for directing pressurized air laterally toward the pattern to achieve the desired uniform packing.

3 Claims, 2 Drawing Sheets

SAND FILL APPARATUS FOR LOST FOAM CASTING

This invention relates to an improvement to a pluviation apparatus for filling a foundry flask with sand particles to embed an expendable pattern within a foundry mold in preparation for casting metal by a lost foam process. More particularly, this invention relates to a pluviation apparatus that comprises a compressed air conduit temporarily insertable into the flask for directing air flow toward the pattern to divert pluviating sand and thereby promote even packing of the sand about the pattern.

In a typical lost foam casting process, an expendable pattern is embedded in a foundry mold formed of unbonded sand particles. Molten metal cast into the mold vaporizes and replaces the pattern to form a product casting. A common pattern design comprises a central downsprue and laterally attached product portions. The pattern is formed of a low density polymeric material, such as polystyrene. A low density of less than 2 pounds per cubic foot is desired to minimize pattern decomposition vapors. However, the lightweight pattern is delicate and susceptible to distortion when packed within the dense sand mold. When metal is cast to duplicate the pattern, this pattern distortion creates distortion in the casting.

One technique for forming a lost foam mold utilizes sand pluviation to fill an open-top flask. The empty flask is positioned beneath a sand pluviation device. The pattern is positioned within the empty flask using a suitable fixture. Sand is charged into the pluviation apparatus and sifts through a perforated lower wall to produce a rainfall of discrete particles that fills the flask and packs about the pattern. In typical production operations, a large volume of sand is rained into the flask within a relatively short period. For example, the time allotted to fill a flask with about 1,800 pounds of sand may be on the order of about 30 seconds. One problem is that the fixture holding the pattern and the pattern itself necessarily interfere with the pluviating sand, causing sand to preferentially accumulate in outer regions of the flask away from the downsprue. This uneven distribution of the sand weight tends to distort the delicate pattern. Also, the pattern typically includes hollows that must be packed with sand to produce corresponding hollows in the casting. However, the uneven distribution of sand during flask fill prevents uniform sand flow into the hollows, which is manifested by incomplete packing of the hollows.

Another technique for forming the mold is by immersing a pattern into a fluidized body of sand within the flask. The body of sand is fluidized by a forceful upward air flow, but packs about the pattern after the air flow is discontinued. However, it has been found that the forceful air flow necessary for fluidization in combination with the mass of the sand tends to distort the delicate pattern. For this reason, sand pluviation has been a preferred technique for embedding a lost foam pattern.

I have now found that a controlled lateral air flow, even though forceful, may be applied during pluviation to promote even packing of sand particles about the pattern and thereby reduce distortion.

It is an object of this invention to provide an improvement to a pluviation apparatus for filling a foundry flask with refractory particles and packing the particles about a prepositioned expendable pattern to form a lost foam casting mold, which improvement includes means for directing gas flow laterally toward the pattern to divert the raining particles and thereby produce a more uniform distribution of the refractory particles as the mold forms about the pattern. This even fill reduces distortion of the pattern and promotes complete packing of hollows within the pattern, so that the resulting casting accurately duplicates the desired pattern shape. Optionally, this invention may be combined with vibration of the flask during fill to reduce the vibrational energy required for satisfactory packing.

SUMMARY OF THE INVENTION

In accordance with a preferred embodiment of this invention, an improvement is provided to apparatus for filling an open-top flask with unbonded sand particles by pluviation to embed an expendable pattern in a foundry mold in preparation for metal casting by a lost foam process. The apparatus comprises a fixture for prepositioning the pattern within the empty flask, and a pluviation device positionable above the flask for creating a rainfall of sand particles into the flask. Preferably, the apparatus also comprises means for vibrating the flask during sand fill to promote dense packing. In accordance with this invention, the apparatus further comprises one or more compressed air conduits generally vertically extendable into the empty flask through the open top for disposition about the prepositioned pattern. The conduits are connected to an external compressed air source and comprise a plurality of orifices for expelling pressurized air, which orifices are located to direct the pressurized air toward the prepositioned pattern.

In preparation for sand fill operations, an empty flask is placed beneath the pluviation device, with a pattern held by the fixture in a desired position within the flask. The compressed air conduits are inserted into the flask about the pattern such that the orifices are directed toward the pattern. A charge of sand is released from the pluviation device and falls into the flask about the pattern. The flask is preferably vibrated to promote sand packing. Concurrent with pluviation, compressed air is admitted into the air conduit and expelled through the orifices thereof toward the pattern. This air flow deflects sand particles toward the pattern to promote packing thereabout, which packing would otherwise be retarded due to diversion of sand particles by the fixture and the pattern. In this manner, a more uniform sand fill is obtained, thereby reducing pattern distortion and improving sand packing within hollows of the pattern. In addition, it is found that the air assist provided by this invention also enhances dense sand packing, thereby reducing the required vibrating force, which force, if excessive, may also create pattern distortion.

DESCRIPTION OF THE DRAWINGS

The present invention will be further illustrated with reference to the accompanying figures wherein.

DETAILED DESCRIPTION OF THE INVENTION

Figure 3:
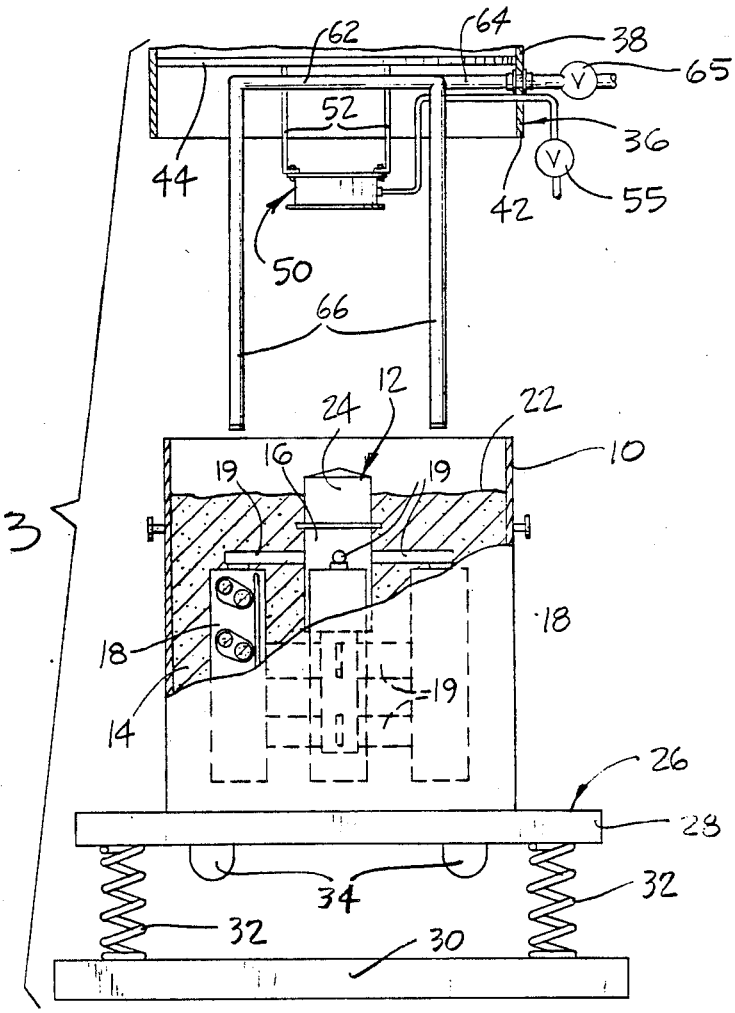
FIG. 3 illustrates, in partial cross-section, the workstation in FIG. 1 following mold forming operations.

Referring to the Figures, there is depicted a preferred workstation for filling an open-top flask 10 with unbonded sand particles to embed a prepositioned polystyrene pattern 12 within a foundry mold 14 in FIG. 3. The sand fill station is one of a series of stations that form a lost foam casting operation. Flask 10 comprises handles 25 for coupling to a suitable conveyer for transporting an empty flask to the fill station and for removing a filled flask from the station for transport to a subsequent station.

In this example, pattern 12 is formed of a lightweight, delicate polystyrene foam material and is generally symmetrical about an axis 13. Pattern 12 comprises a coaxial downsprue portion 16 and product pattern portions 18 disposed laterally about the downsprue and connected thereto by runners 19. In this example, product patterns 18, illustrated schematically, are sized and shaped for producing a casting for an automotive engine cylinder head and comprise a plurality of tortuous passages 20 of various sizes and shapes, including passages that open in the pattern faces 21 that generally face downsprue 16. In order to accurately duplicate passages 20 in a product casting, it is required that passages 20 be packed with sand when the mold is formed. It is also required that the sand pack evenly and densely about downsprue 16, particularly in the space between downsprue 16 and cylinder head patterns 18. Downsprue 16 includes a top pouring portion 24 that is adapted to extend above mold surface 22, as shown in FIG. 3, for admitting pattern-replacement metal into the mold during casting.

The workstation is generally arranged along a vertical axis 13, which axis coincides with the pattern axis when the pattern is positioned in the desired orientation within the flask. At the station, flask 10 preferably sits upon a conventional table-top sand packer 26. Packer 26 comprises a top plate 28 supported upon a base 30 by springs 32. Electric eccentric motors 34 mounted to plate 28 operate in combination with springs 32 to vibrate top plate 28 and thereby to vibrate flask 10 to enhance dense packing of sand therein.

Also at the sand fill station is located a pluviation device 36. Pluviation device 36 is axially movable between a lowered flask-filling position depicted in FIG. 1 and a raised position depicted in FIG. 3 for positioning an empty flask upon packer 26 and removing a filled flask from the station. Pluviation device 36 comprises an open-top sand charge container 38 for receiving a predetermined mass of sand sufficient to fill a flask 10. The container sidewalls extend to form a skirt 42 for surrounding flask 10 during filling to minimize sand loss, but sized to be spaced apart from flask 10 to allow venting of pressurized gas introduced into flask 10 in accordance with this invention. Container 38 further comprises a perforated lower wall 44 through which sand sifts to form a controlled rainfall of discrete particles. Lower wall 44 has a nonperforated border 46 to avoid sand fall outside flask 10.

Pluviation device 36 also carries a fixture 48 for positioning pattern 12 within an empty flask 10 and maintaining the pattern in the desired position during flask fill operations. Fixture 48 comprises a pattern engagement clamp 50 mounted to container lower wall 44 by arms 52. Clamp 50 comprises an air-inflatable ring 54 within an annular housing 56 and operatively connected to an external compressed air source through airline 58. Airline 58 comprises a valve for alternately admitting compressed air to the airline or venting the airline. In a deflated state, ring 50 is sized to provide clearance for inserting a downsprue top 24 of a pattern 12 therein or for releasing the pattern therefrom following flask fill. However, in an inflated condition, the inner diameter of ring 54 contracts so that the ring may engage the downsprue top 24 to thereby grip the pattern.

In accordance with the improvement of this invention, pluviation device 36 also includes means for deflecting pluviating sand within the flask to produce even packing about pattern 12. For this purpose, a square pipe manifold 62 is located adjacent lower wall 44 and is connected to an external compressed air source through a rigid pipe 64 and a valve 65. Pipe 64 extends through an opening in skirt 42 and is secured thereto by pipe fittings 63 to position manifold 62. Four vertical compressed air conduits 66 are rigidly connected from manifold 62 at the corners thereof as shown in FIG. 2. Conduits 66 are inserted axially into flask 10 when pluviation device is in the lowered position shown in FIG. 1. The vertical conduits are arranged within flask 10 so as to be disposed about pattern downsprue 16 intermediate cylinder head patterns 18 as shown in FIG. 2. Each conduit 66 comprises a plurality of equally spaced orifices 68 in an axially aligned arrangement for expelling compressed air admitted thereto from manifold 62 in the direction of arrow 70 toward pattern downsprue 16.

In preparation for lost foam casting operations, the pluviation apparatus 36 operates to embed pattern 12 in flask 10. With the pluviation device 36 in the raised position and ring 54 deflated, pattern top 24 is inserted within clamp 50. Valve 55 is opened to admit compressed air to inflate ring 54 to grip the pattern. An empty flask 10 is conveyed to the work station and set upon top plate 28 of table top packer 26. Pluviation device 36 is then lowered to insert the pattern into the empty flask in the desired position shown in FIG. 1. Conduits 66 carried by pluviation device 36 are concurrently inserted into the flask in preparation for flask fill.

Figure 1:
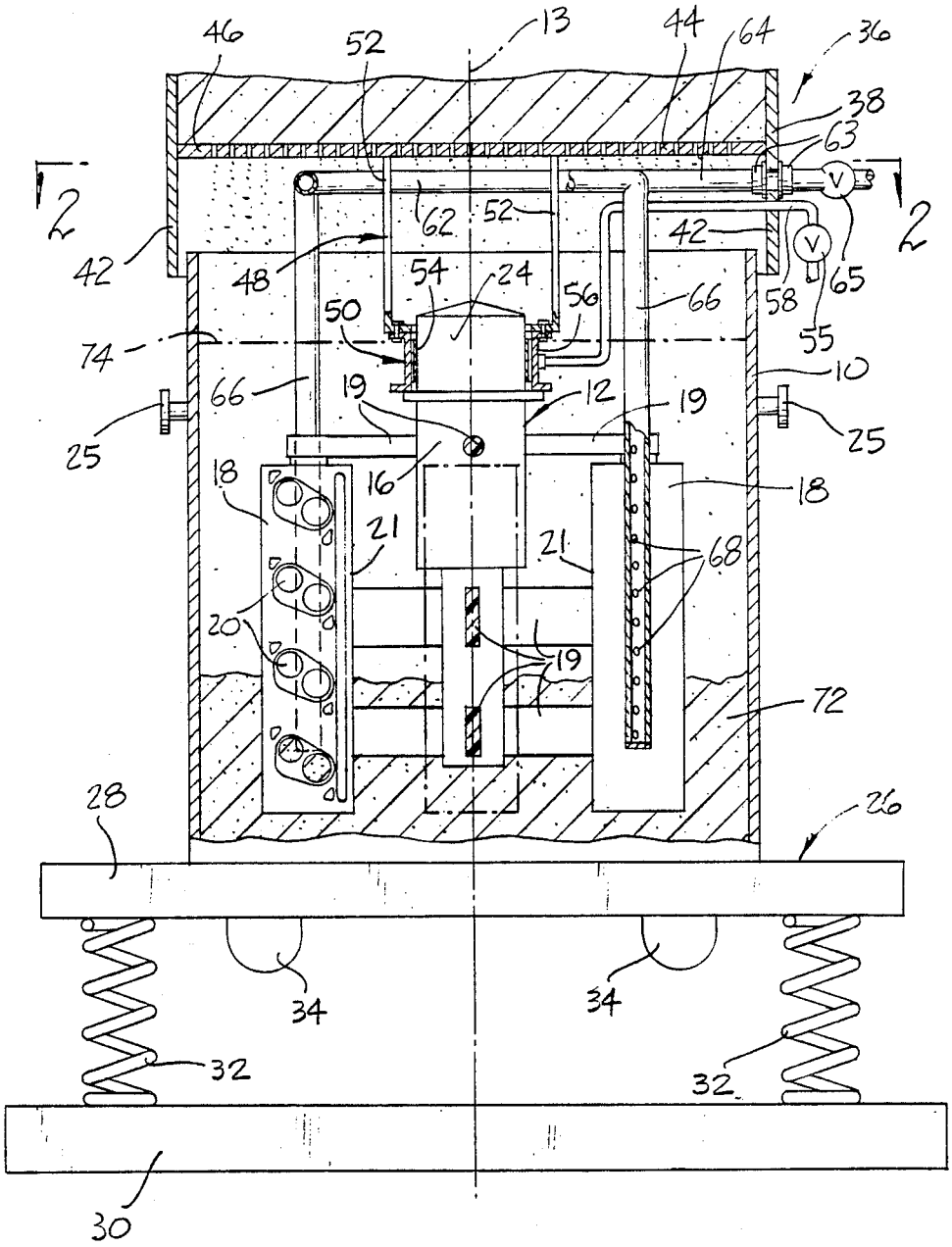
FIG. 1 illustrates, partially in cross-section, a workstation for filling a flask to embed a pattern within a sand mold, which station comprises sand pluviation apparatus and incorporates a preferred embodiment of this invention.
Figure 2:
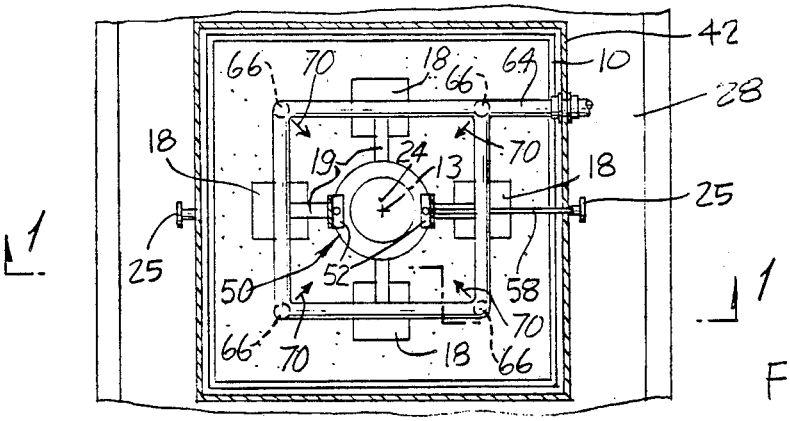
FIG. 2 is a cross-sectional view of the workstation in FIG. 1 taken along line 2—2 in the direction of the arrows.

With the pattern and compressed air conduits in position, a sand mass is loaded into pluviation device 36 through the open top thereof and sifts through lower wall 44, emerging as a rain of discrete sand particles that fall generally parallel to axis 13 into flask 10 and collect to form a bed 72 in FIG. 1 that progressively fills flask 10. Eccentric motors 34 are actuated during sand fill to vibrate flask 10 to densely pack the sand. Also, valve 65 is opened to admit compressed air to manifold 62 and thus to conduits 66. The compressed air blows through orifices 68, producing a forceful air flow in the direction generally perpendicular to axis 13. This lateral air flow in the direction of arrows 70 diverts raining sand toward pattern downsprue 16 and into the space between the downsprue and the product patterns 18. In this manner, bed 72 in FIG. 1 forms more evenly to reduce distortion of the embedded pattern. Also, even sand fill adjacent the downsprue fills openings in the pattern faces to more evenly fill hollows 20.

Sand fill into flask 10 continues until container 38 is emptied of sand, whereupon the sand bed fills flask 10 to fill-line 74. Valve 55 in line 58 is then vented to deflate ring 54 and thereby disengage clamp 50 from pattern 12. Pluviation device 36 is raised to the position shown in FIG. 3. The vertical orientation of conduits 66 permit the conduits to be readily withdrawn from the mold as the pluviation device is raised. Air flow from orifices 68 is preferably continued to facilitate removal from mold 14, whereafter the air flow is discontinued. Thereafter, the vibration produced by motors 34 is discontinued. Filled flask 10 having pattern 12 embedded in mold 14 as seen in FIG. 3 is transferred to a next work station for casting operations.

In the described embodiment, four compressed air conduits 66 are inserted in a parallel manner into flask 10 and are disposed in a four corner arrangement about pattern 12. Each conduit comprises equally spaced orifices that face central axis 13. In this arrangement, diagonally disposed conduits produce opposed air flow to create balanced forces about the pattern. This not only promotes more uniform sand accumulation about the pattern, but also minimizes pattern distortion due to the pressurized air flow, particularly in view of the large volume of air directed toward the pattern by the multiple-orifice conduits in the described embodiment. However, for a particular pattern design, specific regions of the mold may be identified that require additional sand during pluviation to prevent pattern distortion. In an alternate embodiment, this invention may be carried out by a conduit having one or more orifices individually aimed for directing sand adjacent a particular localized region of the pattern. Moreover, sand packing about a complex pattern may be enhanced using a plurality of conduits, each strategically located and having individually aimed orifices to deflect sand into specific regions of the mold susceptable to pattern distortion during pluviation sand fill.

Although in the described embodiment this invention was adapted for use in combination with a pluviation device and pattern fixture of particular design, it may be suitable employed with other such conventional apparatus. Preferably, this invention is used in combination with a vibrational sand packer. Although a table-top packer was described, other apparatus for vibrating the flask may be substituted. Vibration of the flask during or following pluviation promotes dense packing within the mold, but may produce pattern distortion if excessive. It is also found that this invention promotes dense packing generally throughout the mold, thereby reducing the vibrational force necessary to achieve a dense mold suitable for lost foam casting.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. In an apparatus for filling an open-top flask with discrete refractory particles by pluviation to embed an expendable pattern in a foundry mold formed of said unbonded particles in preparation for casting metal by a lost foam process, said apparatus comprising a pluviation device for creating a rainfall of discrete refractory particles, said pluviation device defining a compartment for receiving a mass of refractory particles and comprising a perforated lower wall wherethrough said particles sift to create the rainfall, said pluviation device being positionable above the flask open top so that particles emanating from the lower wall fall into the flask, and a fixture for holding the pattern within the flask during pluviation to position the pattern in a desired orientation for embedment, the improvement comprising means for directing pressurized gas during pluviation in a direction generally perpendicular to the direction of travel of the pluviating particles and toward the pattern, said means comprising at least one compressed gas conduit insertable into the empty flask through the open top thereof for positioning laterally relative to the fixtured pattern, said conduit comprising at least one orifice for expelling pressurized gas in the desired direction with sufficient force to deflect pluviating particles toward the pattern to enhance uniform filling of particles within the flask and thereby reduce distortion of the pattern.

2. In an apparatus for filling an open-top flask with discrete refractory particles by pluviation to embed an expendable pattern in a foundry mold formed of said unbonded particles in preparation for casting metal by a lost foam process, said pattern comprising a central downsprue and product portions laterally connected to the downsprue, said apparatus being arranged along a vertical axis and comprising a pluviation device for creating an axial rainfall of discrete refractory particles, said pluviation device defining a compartment for receiving a mass of refractory particles and comprising a perforated lower wall wherethrough said particles sift to create the rainfall, said pluviation device being axially movable between a lower flask fill position wherein the device is positioned above the flask open top so that particles emanating from the lower wall fall into the flask and a raised position, and a fixture temporarily attachable to the pattern for positioning the pattern within an empty flask in a desired orientation for embedment and for holding the pattern in position during pluviation, the improvement comprising means for directing pressurized gas during pluviation in a direction perpendicular to the direction of travel of the pluviating particles and toward the pattern downsprue, said means comprising a compressed gas conduit mounted to said pluviation device parallel to the axis for axial insertion into the empty flask through the open top thereof when said pluviation device is in the flask fill position and for axial withdrawal from the mold when said pluviation device is moved into the raised position, said conduit being arranged within the empty flask laterally displaced relative to the pattern downsprue and comprising a plurality of orifices for expelling pressurized gas in the desired direction with sufficient force to deflect pluviating sand particles toward the pattern downsprue to enhance uniform filling of particles within the flask and thereby reduce distortion of the pattern.

3. The apparatus according to claim 2 wherein the apparatus is in combination with vibration means for vibrating the flask during pluviation operations to enhance dense sand packing therein.

* * * * *